US005147451A

United States Patent [19]

Leland

[11] Patent Number: 5,147,451

[45] Date of Patent: Sep. 15, 1992

[54] METHOD FOR REFINING REACTIVE AND REFRACTORY METALS

[75] Inventor: John D. Leland, Corvallis, Oreg.

[73] Assignee: Teledyne Industries, Inc., Albany, Oreg.

[21] Appl. No.: 699,606

[22] Filed: May 14, 1991

[51] Int. Cl.[5] ..... C12C 16/00

[52] U.S. Cl. ..... 75/620; 75/612; 75/621

[58] Field of Search ..... 75/612, 620, 621

[56] References Cited

U.S. PATENT DOCUMENTS 4,919,191 4/1990 Brodersen ..... 75/612
4,985,069 1/1991 Travt ..... 75/612

*Primary Examiner*—Stephen J. Lechert, Jr.
*Attorney, Agent, or Firm*—Shoemaker and Mattare, Ltd.

[57] ABSTRACT

A process is disclosed for recovering high purity refractory product metal such as titanium, hafnium, zirconium, vanadium, niobium or their alloys from the regulus of a reduction reaction mixture of a by-product metal halide, excess reducing metal and product metal, which process includes feeding crushed regulus material into a furnace, heating the regulus at temperatures to melt then remove by vaporizing the metal halide and excess reducing metal, and melting the product metal before recovering it from the furnance pool obviating the steps of vacuum distillation or leaching in the recovering step.

6 Claims, No Drawings

METHOD FOR REFINING REACTIVE AND REFRACTORY METALS

FIELD OF THE INVENTION

The present invention relates to the production of refractory metals and the production of homogeneous ingots from unleached and undistilled regulus materials. These metals include zirconium, titanium, hafnium, vanadium, and niobium. Several of these metals are currently produced by the well-known Kroll process or the Hunter process.

For example, zirconium is produced by the reduction of zirconium tetrachloride with magnesium to form zirconium and magnesium dichloride. Titanium may be similarly produced with titanium tetrachloride, or may be produced by the reduction of the titanium tetrachloride with sodium to form titanium and sodium chloride. These are known as product metal halides.

In both the Kroll and the Hunter processes, the desired metal produced (for example, zirconium or titanium) is not fully separated from the byproduct salt (for example, magnesium dichloride or sodium chloride). Instead, the product metal is contained in a matrix of the byproduct salt, along with excess reductant such as magnesium or sodium. The product metal is in the form of extremely small particles (on the order of about one micron) in this matrix. It will be understood that, as is well-known in the art and used herein, the term "regulus material" is taken to mean the product of a Kroll or Hunter reduction reaction. "Regulus material" consists of fine particles of product metal (e.g., Zr, Ti, or Hf) embedded in a matrix of byproduct salt and excess reductant (e.g., Mg & $MgCl_2$ or Na or NaCl).

The term "sponge", in many other patents, refers to the distilled or leached product of a Kroll or Hunter reduction. It is, necessary therefore, to somehow separate the product metal from the byproduct salt and the excess reductant so that the product metal may be recovered in a usable form. Two such methods in common use, vacuum distillation and leaching, suffer from several drawbacks which add to the expense of metals so produced, and which contribute undesired impurities to the metals, namely oxygen and nitrogen.

BACKGROUND OF THE INVENTION

The two methods currently in wide use which separate the produced metal from the byproduct salt and excess reductant are time-consuming and costly. For example, metal produced by the Kroll process (magnesium reduction) is often vacuum distilled. During vacuum distillation, the product of the reduction reaction, in the form of a regulus, is subjected to a vacuum heat treatment, in which the magnesium chloride and excess magnesium are evaporated from the product metal. This process operates at temperatures up to 1000° C., and at vacuum levels down to 10 microns or lower. The final result is a mass of the product metal which has a porous structure. Essentially, the very fine particles of the product metal sinter together during the high temperature and vacuum conditions.

On the other hand, metal produced by the Hunter process is often leached in order to dissolve the sodium chloride and to hydrolyze the excess sodium. This is in preference to vacuum distillation, because sodium chloride is not as volatile as magnesium chloride, and thus is not as easily separated by the vacuum distillation method. In some cases, metal produced by the Kroll process is also leached, although an acid solution must be used to dissolve the excess magnesium.

In the case of vacuum distillation, there are several drawbacks. The vacuum distillation process requires up to five days to effect complete separation of the byproduct salt and excess reductant from the product metal. The product metal is recovered in a porous form which is referred to as "sponge". Sponge is often an undesirable form of the metal, because it has a large specific surface area when compared to consolidated, or homogeneous metal. This large surface area tends to absorb considerable amounts of oxygen from the atmosphere when the metal is exposed to air. As a matter of practice, distilled masses of sponge are crushed down to a small size so that they may be compacted into consumable electrodes for vacuum arc melting. The crushing operation creates a large amount of surface area, which leads to additional oxygen and nitrogen pickup from the atmosphere.

In the case of leaching, while not as much time is required to effect separation, the pickup of impurities is more of a problem. This is due to dissolved gases in leaching solutions, the evolution of gases during dissolution, and the exposure of the leached product to air. Similarly, the product metal is recovered in the form of sponge which is essentially less than desirable. In either case, after the vacuum distillation step or the leaching step, the sponge product metal is typically compacted to form an electrode for vacuum arc melting. In this step, the sponge is melted in a vacuum to form consolidated, homogeneous metal. Typical of the teachings of the prior art are U.S. Pat. Nos. 2,205,854; 2,482,127; and 4,242,136.

SUMMARY OF THE INVENTION

In accordance with the present invention, it has been discovered that substantially complete separation of the product metal from both the byproduct salt and the excess reductant used in the reduction reactions such as the Hunter and the Kroll processes, is achieved by the novel process without the problems of the heretofore necessary steps of vacuum distillation or leaching described above.

This process comprises the steps of:

(1) feeding crushed regulus material into a cold mold induction furnace crucible or a plasma melting furnace;

(2) heating the regulus material at temperatures sufficient to first melt, and removing by vaporization, the byproduct metal halide and the excess reducing metal, finally melting the product metal;

(3) recovering the product metal from the furnace pool.

This invention thus eliminates the vacuum distillation or leaching step in the recovery of the product metal. The regulus of the product metal contained in the matrix of byproduct salt and excess reductant is directly melted after the reduction reaction. The byproduct salt and the excess reductant are first vaporized away from the product metal during the operation (but before the product metal melts), and are condensed on the wall of the melting furnace as disclosed more fully hereafter. After said vaporization, the remaining product metal is melted and consolidated with the underlying ingot.

Refractory metals recovered in pure form as a result of this process include those selected from the group consisting of titanium, hafnium, zirconium, vanadium and niobium. The byproduct metal halides include $MgCl_2$ or NaCl, and the excess reducing metal is Na or Mg.

By eliminating both the vacuum distillation or the leaching steps, a great deal of time is saved. More importantly, the product metal is not exposed to the atmosphere, and thus does not absorb oxygen or nitrogen. The product metal is essentially shielded from the contaminating atmosphere prior to this operation by the surrounding matrix of byproduct salt and excess reductant. In addition, by eliminating both the vacuum distillation or the leaching steps, considerable labor is saved, in addition to the capital cost of the equipment. Substantial energy costs are reduced as well. These are the advantages of this invention.

In a preferred embodiment of the practice of the invention, the reduction regulus is removed to a dry room upon the completion of the reduction reaction in order to prevent the absorption of moisture by the byproduct salt. The regulus is broken up or comminuted into small particles by methods well known to those skilled in the art. These particles may vary considerably in size and according to the process, can vary from as large as 3 inches to as small as ½ inch, for example.

The regulus material is then melted in either an induction type furnace or a plasma type furnace. The general principle is that a quantity of the regulus material is fed by means known to those skilled in the art into the hearth or crucible of the melting furnace. Lining the hearth or crucible is a frozen or partially frozen ("mushy") layer of the product metal. The thus-fed regulus material is then heated up under the action of the induction coil or the plasma torch. As the regulus material is heated up, the byproduct salt and the excess reductant first melt, then vaporize and diffuse away from the product metal. These materials condense on the walls of the furnace, to be drained or otherwise subsequently removed. Meanwhile, under continued heating, the product metal remaining finally melts, and becomes consolidated with the ingot or layer of product metal beneath. As will be seen from Table I, a comparison of the approximate melting points of the by-product salts and reductants are substantially less than those of the product metal as are their approximate boiling points. From this it will be seen that by continuing to heat the regulus, the product metal meets only after the other substances have been vaporized.

TABLE I

| | Approximate Melting Point | Approximate Boiling Point at Atmospheric Pressure |
|---|---|---|
| Mg | 650° C. | 1107° C. |
| $MgCl_2$ | 715° C. | 1420° C. |
| Na | 98° C. | 892° C. |
| NaCl | 800° C. | 1470° C. |
| Zr | 1852° C. | |
| Ti | 1668° C. | |
| Hf | 2222° | |

After this consolidation occurs, the ingot is lowered in the crucible (or the height of the product metal is otherwise adjusted, e.g., some of it may be poured out or drained from a hearth), and the remaining product metal is allowed to freeze or to become mushy. Additional regulus material is added to the hearth or crucible, and the process is repeated.

It has been found that it is beneficial to add undistilled regulus material to the frozen or "mushy" top of a consolidated ingot of the product metal, in contrast to adding the undistilled material directly to a liquid pool of the product metal.

One object of the present invention is to provide a new and improved process for producing refractory metals, such as zirconium, titanium, hafnium and the like, from reduction reaction mixtures wherein the separation of the byproduct salt and the unreacted reductant metals from the desired metals is effected efficiently as to time and cost.

Another object of this invention is to provide a new and improved process for obtaining metals, particularly reactive or refractory metals, which process avoids the steps of vacuum distillation, leaching and the like, typical of the Kroll and Hunter processes, and which provides a product metal of high quality and purity.

A still further object of this invention is to be able to conduct this process under reduced atmospheric pressure without lower pressure limits needed for most plasma furnace operations such as about ⅓ atmosphere.

It is still another object of this invention to provide a novel process whose efficiency and expediency in refining metals substantially decreases the existence of impurities which are otherwise added in the form of gases such as oxygen or nitrogen.

These and still other objects are achieved in the practice of the present invention as hereafter set forth more fully.

DETAILED DESCRIPTION OF THE PREFERRED EMBODIMENTS

In one embodiment of this invention, crushed regulus material is fed into the crucible of a cold mold induction furnace. This type of induction melting furnace is necessary for the melting of reactive and refractory metals due to these metals' attack of all known refractories when the metals are liquid. The cold mold induction furnace, also known as the "Induction Slag" Furnace is described in the U.S. Bureau of Mines Bulletin 673. This art is also taught in U.S. Pat. Nos. 4,838,933; 4,738,713; 4,058,668; and 4,923,508 and described more fully in *The Inductoslag Melting Process,* Bulletin 673, P.G. Clites, U.S. Department of the Interior and incorporated herein. One specific embodiment of this invention is to operate such a furnace while feeding into the crucible of product metal, crushed regulus material by means known to those skilled in the art such as a vibratory feeder. However, it will be understood that various feed means can be employed depending in part on the requirements needed to accommodate consistency, shape and form of the regulus.

In one aspect of the inventive procedure a frozen ingot or "stub" of product metal in the crucible of the furnace is first established. A small quantity of crushed regulus material (on the order of 1 lb.) is fed onto the top of this ingot. The power to activate the heat source is then turned on, and the induction field heats the regulus material. As the material is heated, the byproduct salt and the excess reductant first melt, and then vaporize. The vapors diffuse away from the product metal, and condense on the walls of the furnace. Under continued heating, the remaining product metal melts and becomes consolidated with the ingot below. If necessary, the ingot is retracted somewhat so that the next batch of regulus material may be added. The power source is turned off or reduced, so that the product metal freezes. The process is then repeated until all of the regulus material has been melted, or the desired length of ingot has been formed. In one respect, control of this process is manual, but it is amenable to automatic control and computer assisted processes. A furnace operator skilled in the art can observe the situation in the crucible through the furnace viewport. The operator can easily determine when the byproduct salt and excess reluctant have been vaporized away from the product metal, as the stream of vapors is quite evident. Further, it is relatively easy to determine when the product metal has been consolidated onto the ingot, as this is indicated by the appearance of a distinctive pool of liquid metal. Finally, it is easy for one skilled in the art to determine when the ingot has frozen, as it will lose its color and appear "cold".

It may be seen to those skilled in the art that the temperature control of this process is not overly complicated and no instrumentation is required. It is visually evident to an experienced operator, just when the product metal melts and freezes, and no other temperature information is required.

It may also be seen that the pressure within the furnace is not of great importance. In the range of atmospheric pressure down to vacuum, the byproduct salt and the excess reductant will always vaporize before the product metal melts. Lower pressures assist in the more rapid diffusion of the vapors away from the product, but this effect is not of great significance. Pressures higher than atmospheric pressure would tend to slow the diffusion of the vapors away from the product metal. At very high pressures, the byproduct salt and the excess reductant would exist as liquids along with the product metal, and this would not vaporize away from the product metal until the pressure was reduced. While it would be possible to operate under such high pressures, such operation is not contemplated in this invention. Nevertheless, good results have been obtained when the environment of said furnace pool is closed and comprises a gas selected from the group of gases consisting of argon, helium, neon and krypton. In still a further extension of this process it has been beneficial to use said gases to sweep the vaporized metal halide and reducing metal away.

The preferred pressure range is between about 20 lbs. absolute pressure and vacuum, with ½–1/5 atmosphere a common point.

Those skilled in the art will understand the reason for the batch-type nature of this process. While it would be very beneficial if the regulus material could be added to a liquid pool of the product metal on a continuous basis, the heat transfer between the liquid product metal and the regulus material is extremely rapid, so much so that the byproduct salt and the excess reductant are vaporized so rapidly that objectionable splashing of the liquid product metal occurs. For this reason, the regulus material should not be permitted to contact liquid product metal. It may be seen that this invention provides first for the removal of the byproduct salt and excess reductant from the solid product metal, and second for the melting and consolidation of the product metal. Objectionable splashing caused by rapid vaporization of the byproduct salt and excess reductant is eliminated by preventing contact between the byproduct salt/excess reductant and the liquid product metal.

For the above reason, it is preferable to conduct the process of the invention as close to the top of the hearth or crucible as possible, in order to minimize the cold surface of the crucible which is exposed to the vapors.

In addition to various furnaces disclosed and known, including the induction type, this invention may also be practiced in a plasma melting furnace, such as is well known to those skilled in the art. In such an embodiment, a plasma torch is caused to play upon regulus material which has been fed onto an ingot or "skull" layer of frozen or mushy product metal in the regulus material is added to the pool in any of the manner described above. Because the excess reductant and byproduct salt components are vaporized out of the furnace crucible, they condense on the wall of the furnace chamber, and must be removed. However, by providing a suitable furnace design to accommodate the present invention, the byproduct salt and excess reductant may be condensed as liquids to be drained out rather than as solids to be scraped out.

This invention does not contemplate the use of an electron beam furnace, as the vapors of byproduct salt and excess reductant would interfere with the electron beam. Similarly, it does not claim processes to melt the regulus material in a vacuum arc furnace, such as described in U.S. Pat. No. 2,564,337 (using a non-consumable electrode) and 2,942,969 (consumable electrode).

In the present process, the reduction reaction byproducts are produced in a liquid state during the Hunter or Kroll reaction but then they are allowed to freeze prior to further processing. This is distinguished over the prior art, such as U.S. Pat. No. 3,825,415 and Canadian Patent 770,017 which are concerned with unrelated plasma reduction reactions. In addition, plasma is used to heat up the reactants to a temperature so high that the reduction reaction occurs beneficially. The byproducts are produced initially in a vaporous phase.

EXAMPLE 1

About 60 grams of undistilled/unleached regulus comprising zirconium tetrachloride and magnesium material was melted in a small laboratory plasma furnace. The furnace cathode was a graphite rod, ¼ inch diameter, with a 1/16 inch diameter hole as its axis. The rod was 1½ inches long. A small quantity of argon gas flowed through the hole toward the anode, which was a water cooled copper cup. An electrical discharge was maintained between the cathode and the anode. The voltage was about 20 volts DC, and the current about 150 amps. The argon gas became partially ionized, and constituted a plasma to carry the current. The plasma was played upon the quantity of undistilled regulus material in the cup.

The byproduct salt and the excess reductant (magnesium chloride and magnesium) were first melted and then vaporized by contact with the plasma gas. Periodically, the furnace chamber was partially evacuated to clear the vapors away from the viewport; the vapors condensed on the wall of the furnace chamber. After a brief period, all of the magnesium chloride and magnesium were vaporized, and only homogeneous, consolidated product metal (zirconium) remained. It was thus demonstrated that homogeneous, consolidated product metal may be obtained from regulus material by using a plasma torch to vaporize the byproduct salt and excess reductant.

EXAMPLE 2

1.6 pounds of undistilled/unleached product of a Kroll reduction reaction between zirconium tetrachloride and magnesium were placed in a graphite crucible. The graphite crucible was placed inside an inductively heated graphite susceptor tube within a vacuum chamber. The chamber was evacuated, and power was applied to the induction coil. After 20 minutes of heating at 20 kw, the material could be seen vigorously offgassing through the furnace viewport. An optical pyrometer indicated a temperature of 875° C. After one hour of heating, the offgassing slowed down considerably, and a crust of magnesium chloride and magnesium was observed on the first cold surface out of the susceptor. After three hours of heating, the optical pyrometer indicated a temperature of about 1950° C. (100° C. above the melting point of Zr). The furnace power was shut off, the furnace was allowed to cool, and then opened. The remaining material had not melted due to pickup of carbon from the crucible, but it was free from magnesium chloride or magnesium. Thus, it was to be able to remove those materials in an evacuated induction furnace.

EXAMPLE 3

A cold mold induction furnace such as described in USBM Bulletin 673 was provided with a 4" diameter starting ingot of solid zirconium. On top of this stub was placed 94 grams of undistilled/unleached product of a Kroll reduction reaction between zirconium tetrachloride and magnesium ("regulus material"). This regulus material was in the form of a lumpy square flake, about 2½ on a side and ⅛"-½" thick. The induction furnace was evacuated and backfilled with argon to about 4 psia, and then power was applied. Within two minutes, a dense plume of vapor began to emanate from the regulus material. Some of this vapor condensed on the walls of the furnace, however most of it condensed as a fume suspended in the argon atmosphere within the furnace chamber. This fume obscured the view of the crucible, however it cleared up immediately when vacuum was applied to the chamber.

After several minutes of heating, the vapors ceased to emanate from the crucible. The remaining regulus material, now red hot, was visible atop the underlying ingot; its shape was roughly the same as its original shape. With continued heating, the remaining regulus materials and the top section of the underlying ingot melted at about the same time, consolidating the regulus material with the ingot.

What is claimed is:

1. A process for the recovery of high purity refractory product metal from the regulus of an unleached or undistilled reduction reaction mixture, said mixture comprising a byproduct metal halide, excess reducing metal and product metal, which process comprises:

(1) feeding crushed regulus material into a cold mold induction furnace crucible or a plasma melting furnace;

(2) heating the regulus material at temperatures sufficient to first melt, and removing by vaporization the byproduct metal halide and the excess reducing metal, then melting the product metal.

(3) recovering the product metal from the furnace pool.

2. The process of claim 1 in which said refractory product metal is a member selected from the group consisting of titanium, hafnium, zirconium, vanadium and niobium or the alloys thereof.

3. The process of claim 1 in which said byproduct metal halide is a member selected from the group of $MgCl_2$ and NaCl and said excess reducing metal is Na or Mg.

4. The process of claim 1 in which the melting of byproduct metal halide and consolidating steps employ a member selected from the group consisting of a stub or ingot of regulus, castings, powders, foils, flakes, fibers, crystals and granular materials.

5. The process of claim 1 wherein the product metal is recovered in a pool of liquid metal in said furnace having a closed environment and which environment comprises a vacuum or a gas selected from the group of gases consisting of argon, helium, neon and krypton.

6. The process of claim 1 in which the vaporized by-product metal halide and excess reducing metal are removed by a gas selected from the group of gases consisting of argon, helium, neon and krypton.

* * * * *